US006279345B1

(12) United States Patent
Arman et al.

(10) Patent No.: US 6,279,345 B1
(45) Date of Patent: Aug. 28, 2001

(54) CRYOGENIC AIR SEPARATION SYSTEM WITH SPLIT KETTLE RECYCLE

(75) Inventors: Bayram Arman; Dante Patrick Bonaquist, both of Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/572,840

(22) Filed: May 18, 2000

(51) Int. Cl.[7] ..... F25J 3/00
(52) U.S. Cl. ..... 62/647; 62/652
(58) Field of Search ..... 62/647, 652

(56) References Cited

U.S. PATENT DOCUMENTS

| | | | | |
|---|---|---|---|---|
| 4,617,036 | * | 10/1986 | Suchdeo et al. | 62/652 |
| 4,696,689 | * | 9/1987 | Mori et al. | 62/652 |
| 4,755,202 | | 7/1988 | Cheung | 62/17 |
| 4,867,773 | | 9/1989 | Thorogood et al. | 62/39 |
| 4,883,519 | | 11/1989 | Agrawal et al. | 62/39 |
| 5,074,898 | | 12/1991 | Cheung | 62/38 |
| 5,098,457 | | 3/1992 | Cheung et al. | 62/24 |
| 5,373,699 | | 12/1994 | Gastinne et al. | 62/24 |
| 5,396,772 | | 3/1995 | McKeigue et al. | 62/22 |
| 5,507,148 | | 4/1996 | Mostello | 62/24 |
| 5,528,906 | | 6/1996 | Naumovitz et al. | 62/652 |
| 5,582,034 | | 12/1996 | Naumovitz | 62/652 |
| 5,590,543 | | 1/1997 | Agrawal et al. | 62/643 |
| 5,689,973 | | 11/1997 | Naumovitz et al. | 62/652 |
| 5,711,167 | | 1/1998 | Ha et al. | 62/652 |
| 5,868,006 | | 2/1999 | Kandala | 62/652 |
| 5,899,093 | | 5/1999 | Ha | 62/643 |

* cited by examiner

*Primary Examiner*—Ronald Capossela
(74) *Attorney, Agent, or Firm*—Stanley Ktorides

(57) ABSTRACT

A cryogenic air separation system, which may be used to produce ultra high purity nitrogen or ultra high purity oxygen, wherein kettle liquid is vaporized in two steps using a split kettle top condenser and vapor from the first step compressed and then recycled to the cryogenic rectification column.

8 Claims, 2 Drawing Sheets

FIG. I

CRYOGENIC AIR SEPARATION SYSTEM WITH SPLIT KETTLE RECYCLE

TECHNICAL FIELD

This invention relates generally to cryogenic air separation and, more particularly, to cryogenic air separation wherein ultra high purity product may be produced.

BACKGROUND ART

Oxygen and nitrogen are produced commercially in large quantities and high purities by the cryogenic rectification of air. It is sometimes desired to employ oxygen or nitrogen at an ultra high purity, for example, for use in the electronics industry. While cryogenic air separation systems for producing oxygen or nitrogen at an ultra high purity are known, such system generally produce such product with a significantly reduced recovery.

Accordingly, it is an object of this invention to provide an improved cryogenic air separation system for the production of oxygen or nitrogen at an ultra high purity.

It is another object of this invention to provide an improved cryogenic air separation system which can produce oxygen or nitrogen at an ultra high purity and with high recovery.

SUMMARY OF THE INVENTION

The above and other objects, which will become apparent to those skilled in the art upon a reading of this disclosure, are attained by the present invention, one aspect of which is:

A method for carrying out cryogenic air separation comprising:

(A) passing feed air into a cryogenic rectification column and separating the feed air within the column by cryogenic rectification into nitrogen-enriched top fluid and oxygen-enriched kettle liquid;

(B) partially vaporizing the oxygen-enriched kettle liquid by indirect heat exchange with nitrogen-enriched top fluid to produce oxygen-enriched kettle vapor and remaining oxygen-enriched kettle liquid;

(C) compressing the oxygen-enriched kettle vapor and passing the resulting compressed oxygen-enriched kettle vapor into the cryogenic rectification column;

(D) vaporizing remaining oxygen-enriched kettle liquid by indirect heat exchange with nitrogen-enriched top fluid; and (E) recovering some of the nitrogen-enriched top fluid as product nitrogen.

Another aspect of the invention is:

Apparatus for carrying out cryogenic air separation comprising:

(A) a cryogenic rectification column and means for passing feed air into the cryogenic rectification column;

(B) a split kettle top condenser, a phase separator, means for passing fluid from the lower portion of the cryogenic rectification column to the split kettle top condenser, and means for passing fluid from the split kettle top condenser to the phase separator;

(C) means for passing fluid from the phase separator to the split kettle top condenser, and means for passing fluid from the upper portion of the cryogenic rectification column to the split kettle top condenser;

(D) a compressor, means for passing vapor from the phase separator to the compressor, and means for passing fluid from the compressor to the cryogenic rectification column; and (E) means for recovering fluid from the upper portion of the cryogenic rectification column as product nitrogen.

As used herein the term "feed air" means a mixture comprising primarily oxygen and nitrogen, such as ambient air.

As used herein the term "ultra high purity oxygen" means a fluid having an oxygen concentration of at least 99.99 mole percent with a methane impurity of less than $10^{-8}$ mole percent.

As used herein the term "ultra high purity nitrogen" means a fluid having a nitrogen concentration of at least 99.95 mole percent with an oxygen impurity of less than $10^{-8}$ mole percent.

As used herein the term "column" means a distillation or fractionation column or zone, i.e. a contacting column or zone, wherein liquid and vapor phases are counter currently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Distillation is the separation process whereby heating of a liquid mixture can be used to concentrate the more volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component (s) in the liquid phase. Rectification, or continuous distillation, is the separation process that combines successive partial vaporizations and condensations as obtained by a counter current treatment of the vapor and liquid phases. The counter current contacting of the vapor and liquid phases can be adiabatic or nonadiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein the term "indirect heat exchange" means the bringing of two fluids into heat exchange relation without any physical contact or intermixing of the fluids with each other.

As used herein the terms "turbo expansion" and "turbo expander" mean respectively method and apparatus for the flow of high pressure gas through a turbine to reduce the pressure and the temperature of the gas thereby generating refrigeration.

As used herein the terms "subcooling" and "subcooler" mean respectively method and apparatus for cooling a liquid to be at a temperature lower than the saturation temperature of that liquid for the existing pressure.

As used herein the terms "upper portion" and "lower portion" mean those sections of a column respectively above and below the mid point of the column.

As used herein the term "phase separator" means a vessel wherein incoming two phase feed is separated into individual vapor and liquid fractions. Typically, the vessel has sufficient cross-sectional area so that the vapor and liquid are separated by gravity.

As used herein the term "stripping column" means a column operated with sufficient vapor upflow relative to liquid downflow to achieve separation of a volatile component from the liquid into the vapor in which the volatile component becomes progressively richer upwardly.

As used herein the term "split kettle top condenser" means a condenser wherein two different kettle liquid streams provide refrigeration to condense nitrogen-enriched vapor without rectification.

DETAILED DESCRIPTION

Figure 1:
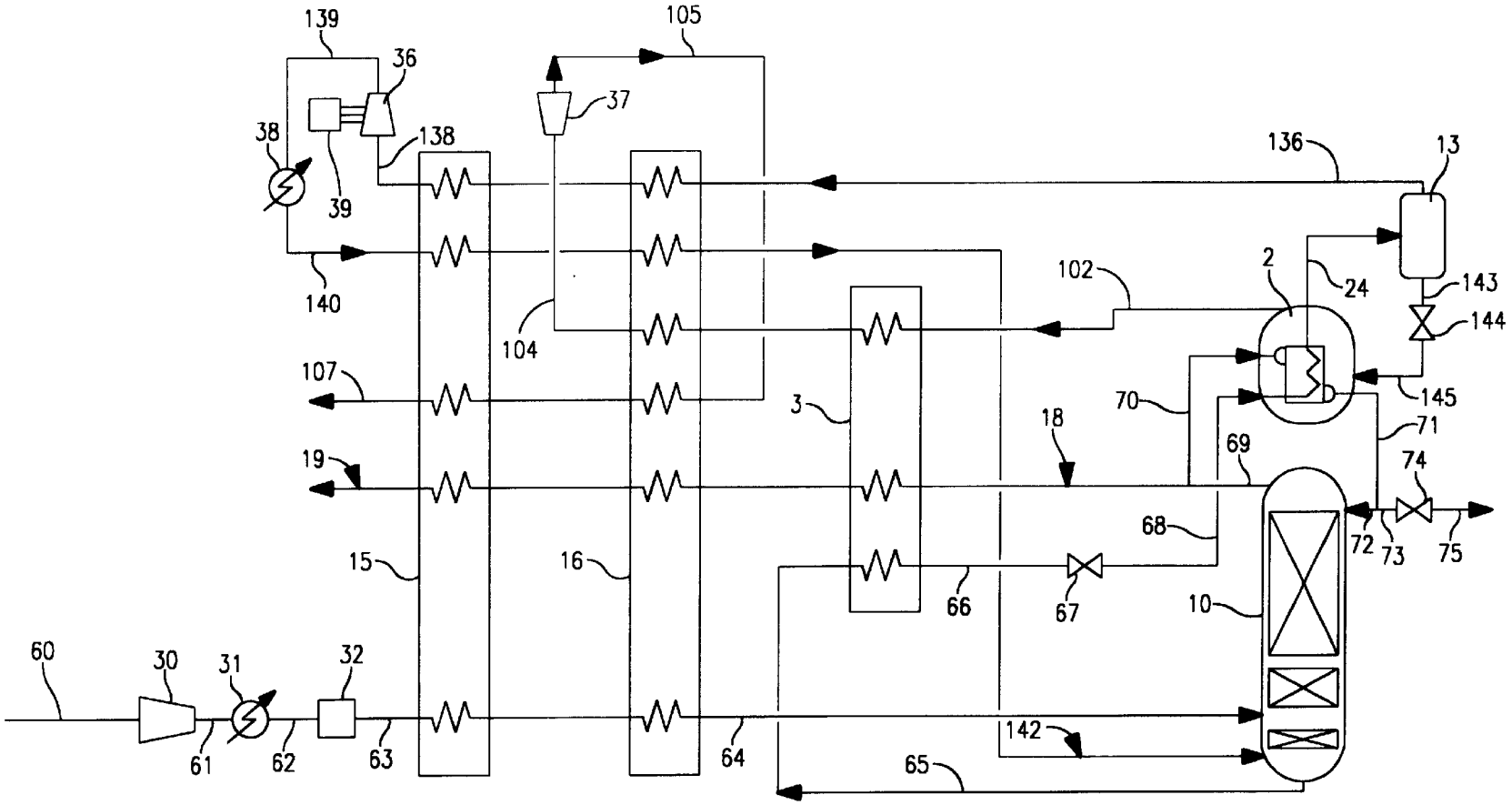
FIG. 1 is a schematic representation of one preferred embodiment of the cryogenic air separation system of this invention whereby ultra high purity nitrogen may be produced.

The invention will be described in detail with reference to the Drawings. Referring now to FIG. 1, feed air 60 is compressed by passage through base load air compressor 30 to a pressure generally within the range of from 30 to 300 pounds per square inch absolute (psia). Resulting compressed feed air 61 is cooled of the heat of compression by passage through cooler 31 and then passed as stream 62 to purifier 32 wherein it is cleaned of high boiling impurities such as water vapor, carbon dioxide and hydrocarbons. Cleaned feed air stream 63 is cooled by indirect heat exchange with return streams in heat exchangers 15 and 16 and resulting cooled, cleaned, compressed feed air stream 64 is passed into cryogenic rectification column 10.

Cryogenic rectification column 10 is operating at a pressure generally within the range of from 30 to 300 psia. Within cryogenic rectification column 10 the feed air is separated by cryogenic rectification into nitrogen-enriched top fluid and oxygen-enriched bottom fluid. Oxygen-enriched bottom fluid is withdrawn from the lower portion of column 10 as liquid stream 65 and is subcooled by passage through subcooler 3. Resulting subcooled oxygen-enriched liquid stream 66 is passed through valve 67 and then as stream 68 is passed into split kettle top condenser 2 wherein it is partially vaporized by indirect heat exchange with condensing nitrogen-enriched top fluid, as will be more fully discussed below, to form two phase stream 24. Generally from about 30 to 70 percent of stream 68 is vaporized by passage through split kettle top condenser 2.

Two phase stream 24 is passed from split kettle top condenser 24 into phase separator 13 wherein it is separated into oxygen-enriched kettle vapor and remaining oxygen-enriched kettle liquid. Oxygen-enriched kettle vapor is withdrawn from separator 13 in stream 136, warmed by passage through primary heat exchangers 16 and 15 and then passed in stream 138 to compressor 36, driven by motor 39 wherein it is compressed to a pressure generally within the range of from 30 to 300 psia. Resulting compressed oxygen-enriched kettle vapor 139 is cooled of the heat of compression by passage through cooler 38 and resulting oxygen-enriched kettle vapor 140 is cooled by passage through primary heat exchangers 15 and 16 and then recycled as stream 142 into cryogenic rectification column 10.

Remaining oxygen-enriched liquid is passed from phase separator 13 in stream 143 through valve 144 and as stream 145 back into split kettle top condenser 2 wherein it is vaporized by indirect heat exchange with condensing nitrogen-enriched top fluid. The resulting vaporized remaining oxygen-enriched fluid 102 is warmed by passage through heat exchangers 3 and 16 to form stream 104 which is turbo expanded by passage through turboexpander 37 to generate refrigeration. Resulting refrigeration bearing stream 105 is warmed by passage through primary heat exchangers 16 and 15 thereby cooling incoming streams for passing refrigeration into the column to drive the separation. Resulting warmed stream 107 is then removed from the system.

Nitrogen-enriched top fluid is withdrawn from the upper portion of cryogenic rectification column 10 as vapor stream 69. If desired, a portion 18 of the nitrogen-enriched top vapor may be warmed by passage through heat exchangers 3, 16 and 15 and then recovered as product nitrogen vapor in stream 19. Preferably the product nitrogen vapor in stream 19 is ultra high purity nitrogen. At least a portion 70 of nitrogen-enriched top vapor 69 is passed into split kettle top condenser 2 wherein it is condensed by indirect heat exchange with oxygen-enriched liquid as was previously described. Resulting nitrogen-enriched liquid 71 is passed as reflux 72 into column 10. Stream 71 has the same nitrogen concentration as does stream 70. If desired a portion 73 of stream 71 is passed through valve 74 and recovered as product nitrogen liquid in stream 75. Preferably the product nitrogen liquid in stream 75 is ultra high purity nitrogen.

Figure 2:
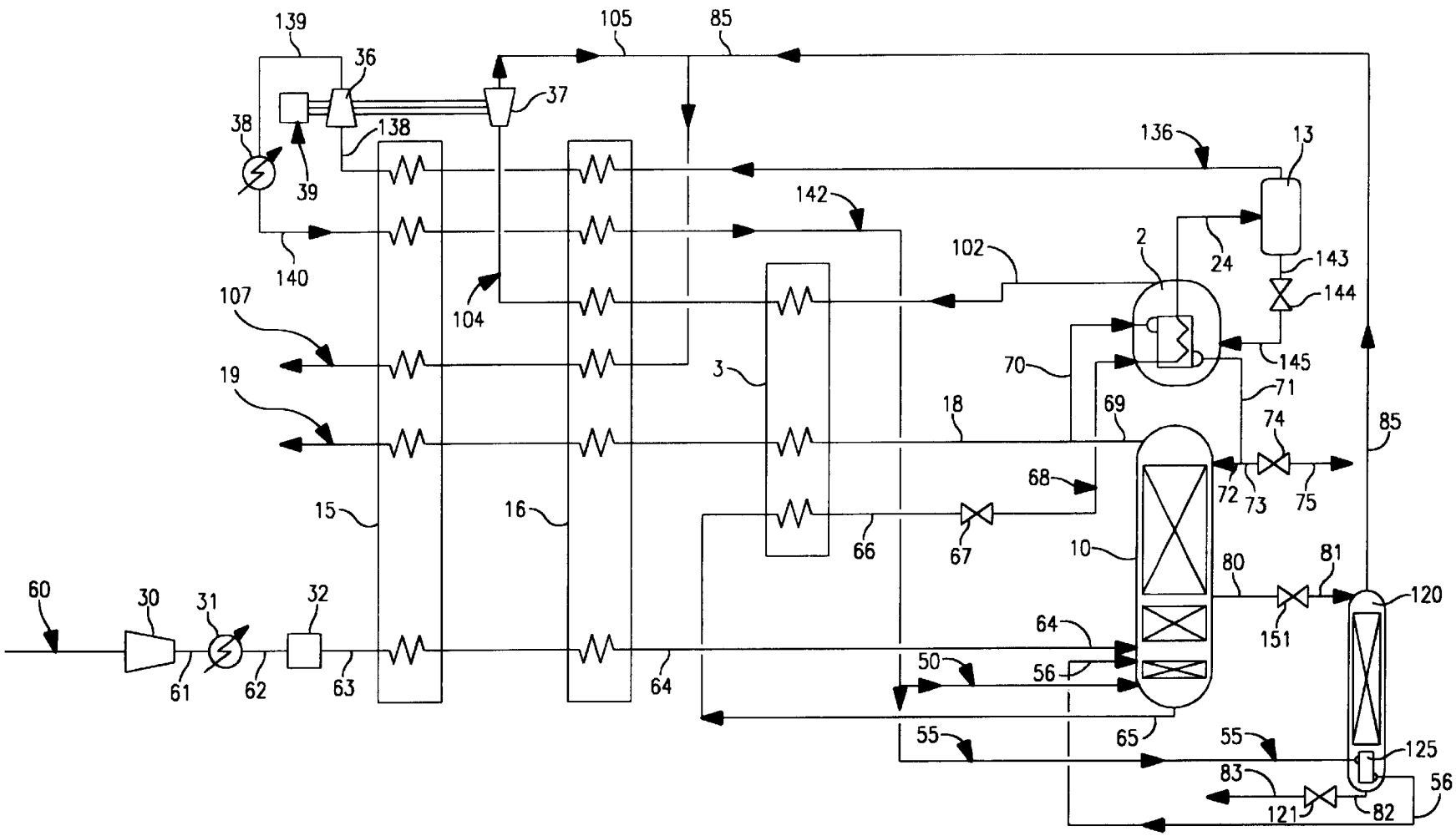
FIG. 2 is a schematic representation of another preferred embodiment of the cryogenic air separation system of this invention whereby ultra high purity oxygen may be produced.

FIG. 2 illustrates another preferred embodiment of the invention wherein ultra high purity oxygen may be produced. The numerals of FIG. 2 are the same as those of FIG. 1 for the common elements and these common elements will not be discussed again in detail.

Referring now to FIG. 2, oxygen-containing liquid, generally having an oxygen concentration within the range of from 30 to 95 mole percent, is passed in stream 80 from cryogenic rectification column 10 through valve 151 and as stream 81 into the upper portion of stripping column 120 which is operating at a pressure generally within the range of from 14 to 50 psia. The oxygen-containing liquid passes down through stripping column 120 against upflowing vapor and in the process more volatile impurities, e.g. argon, within the oxygen-containing liquid are passed or stripped out of the downflowing liquid into the upflowing vapor. The impurity containing vapor is removed from the upper portion of stripping column 120 in stream 85 which is combined with stream 105 and then passed out of the system. As can be seen, in the embodiment illustrated in FIG. 2, turboexpander 37 is mechanically connected to compressor 36 thus serving to assist in driving compressor 36.

The downflowing liquid collects in the bottom portion of stripping column 120 as high purity oxygen liquid. A portion of the high purity oxygen liquid is withdrawn from the lower portion of column 120 in stream 82, passed through valve 121 and recovered as liquid oxygen product in stream 83. Preferably the liquid oxygen product is ultra high purity oxygen.

In the embodiment of the invention illustrated in FIG. 2, only a portion 50 of compressed oxygen-enriched vapor 142 is passed directly in cryogenic rectification column 10. Another portion 55 of stream 142 is passed into bottom reboiler 125 in the sump of stripping column 120 wherein it is condensed by indirect heat exchange with high purity oxygen liquid thereby vaporizing some of the high purity oxygen liquid which serves as the aforesaid upflowing vapor. The resulting condensed oxygen-enriched fluid is passed out of reboiler 125 in stream 56 and then passed into cryogenic rectification column 10. If desired, all of stream 142 may be condensed in reboiler 125 before being recycled into column 10.

Although the invention has been described in detail with reference to two preferred embodiments, those skilled in the art will recognize that there are other embodiments of the invention within the spirit and the scope of the claims. For example, a separate compressor for the oxygen-enriched vapor recycled into the cryogenic rectification column need not be employed, and this stream could be passed to the base load air compressor for compression and then passed into the cryogenic rectification column with the feed air. In another example, the oxygen-enriched recycle could be compressed at cryogenic conditions and passed to the cryogenic rectification column. The heat of compression may be removed by cooling the cryogenically compressed stream through the cold leg of the main heat exchanger to remove heat of compression prior to entering into the cryogenic rectification column. Moreover, some or all of the refrigeration needed to carry out the separations could be generated using a multicomponent refrigerant fluid circuit thereby reducing or eliminating entirely the need to use turboexpansion to generate the refrigeration.

What is claimed is:

1. A method for carrying out cryogenic air separation comprising:

(A) passing feed air into a cryogenic rectification column and separating the feed air within the column by cryogenic rectification into nitrogen-enriched top fluid and oxygen-enriched kettle liquid;

(B) partially vaporizing the oxygen-enriched kettle liquid by indirect heat exchange with nitrogen-enriched top fluid to produce oxygen-enriched kettle vapor and remaining oxygen-enriched kettle liquid;

(C) compressing the oxygen-enriched kettle vapor and passing the resulting compressed oxygen-enriched kettle vapor into the cryogenic rectification column;

(D) vaporizing remaining oxygen-enriched kettle liquid by indirect heat exchange with nitrogen-enriched top fluid; and (E) recovering some of the nitrogen-enriched top fluid as product nitrogen.

2. The method of claim 1 wherein the product nitrogen is ultra high purity nitrogen.

3. The method of claim 1 further comprising passing an oxygen-containing liquid from the cryogenic rectification column into and down a stripping column against upflowing vapor, passing impurities from the downflowing oxygen-containing liquid into the upflowing vapor, forming a high purity oxygen liquid in the lower portion of the stripping column, and recovering a portion of the high purity oxygen liquid as product oxygen from the lower portion of the stripping column.

4. The method of claim 3 wherein the product oxygen is ultra high purity oxygen.

5. The method of claim 3 further comprising condensing a portion of the compressed oxygen-enriched kettle vapor by indirect heat exchange with the high purity oxygen liquid, and then passing the resulting condensed oxygen-enriched fluid into the cryogenic rectification column.

6. Apparatus for carrying out cryogenic air separation comprising:

(A) a cryogenic rectification column and means for passing feed air into the cryogenic rectification column;

(B) a split kettle top condenser, a phase separator, means for passing fluid from the lower portion of the cryogenic rectification column to the split kettle top condenser, and means for passing fluid from the split kettle top condenser to the phase separator;

(C) means for passing fluid from the phase separator to the split kettle top condenser, and means for passing fluid from the upper portion of the cryogenic rectification column to the split kettle top condenser;

(D) a compressor, means for passing vapor from the phase separator to the compressor, and means for passing fluid from the compressor to the cryogenic rectification column; and (E) means for recovering fluid from the upper portion of the cryogenic rectification column as product nitrogen.

7. The apparatus of claim 6 further comprising a stripping column having a bottom reboiler, means for passing fluid from the cryogenic rectification column into the upper portion of the stripping column, and means for recovering fluid from the lower portion of the stripping column as product oxygen.

8. The apparatus of claim 7 further comprising means for passing fluid from the compressor to the bottom reboiler, and means for passing fluid from the bottom reboiler to the cryogenic rectification column.

* * * * *